US009351621B2

(12) United States Patent
Cordes et al.

(10) Patent No.: US 9,351,621 B2
(45) Date of Patent: May 31, 2016

(54) VACUUM CLEANER SUCTION PIPE

(71) Applicant: Fischer Rohrtechnik GmbH, Achern-Fautenbach (DE)

(72) Inventors: Martin Cordes, Sundern (DE); Stephan Cordes, Arnsberg (DE)

(73) Assignee: fischer Rohrtechnik GmbH, Achern-Fautenbach (DE)

( * ) Notice: Subject to any disclaimer, the term of this patent is extended or adjusted under 35 U.S.C. 154(b) by 460 days.

(21) Appl. No.: 13/719,268

(22) Filed: Dec. 19, 2012

(65) Prior Publication Data

US 2013/0175794 A1 Jul. 11, 2013

(30) Foreign Application Priority Data

Dec. 19, 2011 (DE) ..... 10 2011 121 350

(51) Int. Cl.
*A47L 9/24* (2006.01)

(52) U.S. Cl.
CPC .. *A47L 9/24* (2013.01); *A47L 9/244* (2013.01)

(58) Field of Classification Search
CPC ..... A47L 9/24; A47L 9/242; A47L 9/244; B25G 1/04; F16L 27/12; F16L 27/125
USPC ..... 285/7, 302, 303, 145.1
See application file for complete search history.

(56) References Cited

U.S. PATENT DOCUMENTS 3,244,437 A * 4/1966 Belicka ..... A47L 9/244 15/414
4,949,809 A * 8/1990 Levi ..... E06C 7/423 182/172
4,960,015 A * 10/1990 Mathews ..... B25B 13/481 16/429
5,692,782 A * 12/1997 Fischer ..... A47L 9/244 285/24
5,836,620 A * 11/1998 Wang et al. ..... 285/7
6,431,607 B1 * 8/2002 Kittelmann ..... A47L 9/244 285/303
6,474,696 B1 * 11/2002 Canale ..... A47L 9/244 285/316
6,513,191 B1 * 2/2003 Kim ..... A47L 9/244 15/414
7,334,503 B1 * 2/2008 Newman ..... H01K 3/32 294/184
2002/0063427 A1 * 5/2002 Schiemann et al. ..... 285/316
2010/0072740 A1 * 3/2010 Cordes et al. ..... 285/7

FOREIGN PATENT DOCUMENTS

EP 0 937 435 A2 8/1999

* cited by examiner

*Primary Examiner* — Daniel P Stodola
*Assistant Examiner* — Zachary Dragicevich
(74) *Attorney, Agent, or Firm* — Roberts Mlotkowski; Safran & Cole, P.C.; David S. Safran

(57) ABSTRACT

A vacuum cleaner suction pipe with at least one inner and at least one outer pipe, and at least one locking device, the locking device being movable by manual actuation, the locking device having a toothed rack, and in the locking position the rack being kept engaged to a toothed strip of the inner pipe, as a result of which the position of the inner pipe is fixed relative to the outer pipe. The locking device is movable into a release position by axial displacement relative to the outer pipe, and in the release position, the rack can be disengaged from the toothed strip by a relative force between the outer pipe and inner pipe, without the effect of a spring force, by the flanks of the teeth of the toothed strip pushing the flanks of the teeth of the rack upward.

14 Claims, 3 Drawing Sheets

VACUUM CLEANER SUCTION PIPE

BACKGROUND OF THE INVENTION

1. Field of the Invention

The invention relates to a vacuum cleaner suction pipe with at least one inner pipe, at least one outer pipe, and at least one locking device, the inner pipe having a toothed strip, the locking device being attached to the outer pipe, the locking device being movable by manual actuation by a user from a locking position into a release position, the locking device having a toothed rack, and the rack being kept engaged to the toothed strip of the inner pipe in the locking position, as a result of which the position of the inner pipe is fixed relative to the outer pipe.

2. Description of Related Art

Vacuum cleaner suction pipes are known in the prior art in a host of configurations. Vacuum cleaner suction pipes establish the connection between the suction hose of a vacuum cleaner and the suction tool, for example, a floor nozzle. In order to match the length of the vacuum cleaner suction pipe to the individual requirements of a user, vacuum cleaner suction pipes can be changed with respect to their length by, for example, a inner pipe being telescopically guided in an outer pipe. The length of the vacuum cleaner suction pipe is set incrementally by relative displacement of the inner pipe relative to the outer pipe. The shortest distance of a change in length is determined, for example, by the minimum distance of a catch depression which is used to lock the pipes relative to one another.

European Patent Application EP 0 937 435 A2 discloses a vacuum cleaner suction pipe with an inner pipe and an outer pipe, the inner pipe having embossed depressions which interact with a locking mechanism which is attached to the outer pipe. Here, the locking mechanism has elastic catch hooks which in the locking position engage the embossed depressions in the inner pipe and thus fix the position of the inner pipe relative to the outer pipe. By actuating the locking mechanism, the catch hook is enabled to move aside so that it moves elastically aside out of the depressions in the inner pipe opposite the spring force applied by its holder, as a result of which resetting the position of the inner pipe relative to the outer pipe by the user is enabled. As soon as the next catch depression is reached, the spring force leads to the catch hook being pressed into it.

The vacuum cleaner suction pipes known from the prior art have the disadvantage that a relatively temporary stabilization of the set position between the inner pipe and outer pipe can only be accomplished with an additional spring force which is acting on the spring elements so that, even with the locking mechanism released by the user, a spring force must always be overcome in order to move the inner pipe relative to the outer pipe; this means additional effort for the user. Furthermore, the known vacuum cleaner suction pipes have the disadvantage that the distance between the locking positions is relative large, as a result of which only rough adjustment is possible.

SUMMARY OF THE INVENTION

Proceeding from the aforementioned prior art, a primary object of the present invention is to devise a vacuum cleaner suction pipe which enables precise and simple adjustment of the length.

This object is achieved in a vacuum cleaner suction pipe in that the locking device can be moved into the release position by displacement relative to the outer pipe and in the axial direction of the outer pipe and that the rack can be disengaged from the toothed strip in the release position by a relative force between the outer pipe and inner pipe without the effect of a spring force by the flanks of the teeth of the toothed strip pushing the flanks of the teeth of the rack upward, as a result of which the inner pipe can be displaced relative to the outer pipe. Thus, the locking device can be moved into at least one release position by manual displacement in the axial direction of the outer pipe. In the release position, the locking device releases a movement of the rack to disengage from the toothed strip so that the rack can be pressed back without the effect of a spring force for example, into a rebound, as a result of which the inner pipe and the outer pipe can be displaced relative to one another.

The inner pipe is guided in the outer pipe, preferably the outside diameter of the inner pipe corresponding to the inside diameter of the outer pipe. The length of the vacuum cleaner suction pipe, therefore the length of the outer pipe with the following inner pipe, is adjusted by displacement of the inner pipe relative to the outer pipe or of the outer pipe relative to the inner pipe. The space surrounded by the inner pipe and by the outer pipe forms the suction channel which can be used in the operation of the vacuum cleaner suction pipe from the end of the inner pipe facing away from the outer pipe to the end of the outer pipe facing away from the inner pipe.

To prevent the length of the vacuum cleaner suction pipe from being unintentionally reset during use, there is a locking device which fixes the position of the inner pipe relative to the outer pipe or of the outer pipe to the inner pipe. The locking device has a rack whose teeth in the locking position are kept engaged to the teeth of the toothed strip in one wall of the inner pipe, as a result of which a relative movement of the inner pipe to the outer pipe is blocked. The intermeshing teeth of the toothed strip and the rack lead to a transfer of force between the inner pipe and outer pipe which prevents a relative movement of the inner pipe relative to the outer pipe. The toothed strip in the inner pipe is preferably embossed into the wall of the inner pipe. Preferably, a stainless steel is suitable as a material for the inner pipe and the outer pipe.

The locking device in the deactivated state is advantageously in the locking position so that relative movement of the outer pipe relative to the inner pipe is prevented without actuation of the user. If a user moves the locking device by manual actuation out of the locking position into the release position by displacing the locking device manually in the axial direction of the outer pipe or of the inner pipe relative to the outer pipe, a movement of the rack to disengage from the toothed strip is released. Here, it is not necessary that all components of the locking device be displaced in the axial direction, but it is sufficient if only one individual component, or a plurality of components of the locking device, is/are moved.

The rack can thus move in the release position radially relative to the vacuum cleaner suction pipe without a spring force, or with another elastic force, acting on the rack. In the release position, only the weight of the rack is acting on it; the rack is otherwise preferably free of force. The rack is kept in its position preferably by form-fit with little play.

If the locking device is in the release position and a user produces a force acting in the axial direction between the inner pipe and outer pipe for example, by restraining the outer pipe and applying an axial force to the inner pipe, the flanks of the teeth of the toothed strip are pushed up on the flanks of the teeth of the rack so that the rack advances in the manner of a ratchet on the toothed strip while the inner pipe is telescoped relative to the outer pipe. The rack can consequently move free of spring force on the toothed strip as long as the locking device is in the release position. Depending on the alignment of the vacuum cleaner suction pipe, the rack is kept engaged to the toothed strip simply by its weight which can be overcome by applying the relative force.

Preferably, the teeth of the toothed strip and the teeth of the rack are the same size so that advantageous engagement of the teeth to one another takes place. The teeth of the toothed strip and the teeth of the rack, furthermore, preferably have straight teeth so that the flanks can advantageously slide past one another in the release position. The teeth of the toothed strip and the teeth of the rack are arranged orthogonally to the axis of the outer pipe and inner pipe.

That the rack can move completely freely in the locking device in the release position can also be realized due to the fact that the rack is underneath the outer pipe and the inner pipe when the vacuum cleaner suction pipe is kept in the release position, and the rack is lifted by the force of its weight to disengage from the toothed strip so that a telescoping of the inner pipe relative to the outer pipe is possible without the teeth of the toothed strip being pushed up on the teeth of the rack.

The described vacuum cleaner suction pipe has the advantage that the actuation of the locking device takes place in the identical direction with the resetting direction of the inner pipe and of the outer pipe, as a result of which especially advantageous resetting by a user can take place since the forces for unlocking and resetting are applied in the same axis. Consequently, a user can grasp the locking device with one hand in order to move it into the release position while with the other hand he applies a displacement force to the inner pipe so that the inner pipe moves relative to the outer pipe and adjustment of the length of the vacuum cleaner suction pipe takes place. The plurality of teeth on the rack and the toothed strip has the advantage compared to locking devices with only one or two catch hooks that a larger area is available for transfer of force. Due to the large area, a spring force for holding the catch hooks in their engagement position is unnecessary.

Furthermore, it is also provided that there is a plurality of inner pipes or a plurality of outer pipes so that there is also a plurality of locking devices, as a result of which the vacuum cleaner suction pipe can be reset at several locations which preferably correspond to the number of locking devices.

In order to further simplify the adjustment of the length of the vacuum cleaner suction pipe for a user, according to a first configuration, it is provided that the locking device has a spring and that, when the locking device is deflected out of the locking position, the spring induces a force with which the locking device can be set back into the locking position. The spring is preferably unloaded, or in any case only slightly loaded, in the locking position so that the locking device is kept in the locking position when there is no actuation by a user. At this point, if the user deflects the locking device out of the locking position by displacing the locking device relative to the outer pipe in its axial direction, the spring is elongated or compressed so that it causes a reset force out of the release position into the locking position. The locking device is thus always automatically set back into the locking position when the user is not acting on the locking device. For the release position, this means that the locking device must be actively held by the user in the release position in order to reset the length of the vacuum cleaner suction pipe.

The spring is preferably made as a helical spring which is loaded in tension and/or compression. Alternatively, the spring is made, for example, as a metal ring from a spring steel which is deflected such that a reset force is caused. The force of the spring always acts such that the locking device is reset into the locking position. Any spring element which is suitable for applying a reset force to the locking device is suitable as a spring.

In order to simplify the actuation of the locking device by a user, according to another configuration, it is provided that the locking device has an outer sleeve, that the outer sleeve is slipped onto an end region of the outer pipe and that the release position is reached by axial displacement of the sleeve. The displacement of the outer sleeve as part of the locking device consequently leads to a movement of the rack being released to disengage from the toothed strip and the flanks of the teeth of the rack being pushed up on the flanks of the teeth of the toothed strip by the relative force which is applied by the user. The outer sleeve is preferably made and produced of closed ring shape and it is slipped onto the outer pipe for mounting at an end region and attached to it. The outer sleeve is movably attached to the outer pipe, specifically, so that it can be displaced at least slightly in the axial direction of the outer pipe.

To reset the length of the vacuum cleaner suction pipe, for example, a user grasps the outer sleeve on the outer pipe with one hand and displaces it in the axial direction into the release position, so that the length of the vacuum cleaner suction pipe can be set by displacing the inner pipe with the other hand. The configuration of the outer sleeve as a component which is closed in a ring-shape, as compared to sleeves assembled from several half shells, has the advantage that a greater stability and more demanding haptic impression can be achieved.

According to another configuration, it has been found to be advantageous if the outer sleeve has a bridge, that the bridge extends through the wall of the outer pipe in an opening, and that the bridge interacts with the spring which is located in the outer pipe. The outer sleeve is movably attached on the outer pipe, the bridge being located on the side of the outer sleeve facing the outer pipe and penetrating the wall of the outer pipe which has an opening for this purpose. The end of the bridge is consequently located within the outer pipe. The spring which is also preferably located within the outer pipe is connected, for example, to the bridge so that when the outer sleeve is moved relative to the outer pipe the spring is actuated by the bridge and thus also its reset force into the locking position is applied via the bridge to the outer sleeve, and thus, to the locking device. The bridge is preferably made integral with the outer sleeve.

Furthermore, according to another configuration, it has been found to be advantageous if the outer pipe is widened in an end region, that the locking device has an inner sleeve and that the inner sleeve is located in the widened end region. The outer pipe is preferably widened at least in the end region which is facing the inner pipe. The widening is can be a partial or complete enlargement of the inside diameter and outside diameter of the outer pipe in a section in the end region.

The widening corresponds preferably to the material thickness of the inner sleeve which is located in this end region so that the inside diameter of the inner sleeve corresponds roughly to the outside diameter of the inner pipe. The inner sleeve is preferably tightly joined to the outer pipe so that, for example, the spring is held on the inner sleeve for resetting the locking device into the locking position. Alternatively, the inner sleeve also has sealing elements which seal the transition region between the inner pipe and outer pipe.

Furthermore, it is provided that the rack is guided in the inner sleeve, for example, by the rack being guided in an opening in the inner sleeve with little play so that a movement of the rack radially to the vacuum cleaner suction pipe is possible, but a movement of the rack, except for the small play, in the other directions of space is prevented by the inner sleeve. The rack is preferably fixed in its position relative to the inner sleeve. In the mounted state, consequently, the wall of the outer pipe with the widened end region is between the inner sleeve and the outer sleeve.

To ensure a reliable locking in the locking position, according to another configuration it is provided that the locking device has a clamping bridge, that the clamping bridge in the locking position acts on the surface of the rack opposite the teeth, and that the clamping bridge in the release position releases a movement of the rack to disengage it from the toothed strip. In the locking position, the clamping bridge acts on the back—specifically, the surface of the rack opposite the teeth—and thus, presses the rack—the teeth of the rack—to engage the toothed strip, as a result of which a movement of the inner pipe relative to the outer pipe is prevented. The clamping bridge in the locking position for example, applies a force to the rack which is pointed radially at the vacuum cleaner suction pipe.

In the release position, the contact between the clamping bridge and the rack is changed such that the rack can move away from the toothed strip, as a result of which the teeth of the rack no longer engage the teeth of the toothed strip and telescoping of the inner pipe to the outer pipe can take place. The clamping bridge is influenced by axial displacement at least of one part of the locking device, preferably the outer sleeve, for release or locking.

The interaction between the clamping bridge and the rack, according to another configuration, is improved by the clamping bridge having clamping teeth, by the rack having control teeth on the surface facing away from the teeth, by the tips of the clamping teeth in the locking position acting on the control teeth, and by the clamping bridge being moved relative to the rack by an axial displacement of the locking device so that the clamping teeth and the control teeth can be caused to engage in the release position.

In the locking position, the tips of the clamping teeth, which are preferably flattened cause a force on the control teeth of the rack, the force preferably also being induced on the tips of the control teeth, which also are preferably flattened. In the locking position, the rack is kept engaged to the toothed strip by the transfer of force between the clamping teeth and the control teeth. To reach the release position, the clamping bridge is moved relative to the rack, preferably in the axial direction of the outer pipe, as a result of which the tips of the clamping teeth are no longer on the tips of the control teeth, but the clamping teeth and the control teeth can be caused to engage, as a result of which a movement of the rack in the radial direction to the vacuum cleaner suction pipe is possible and corresponds roughly to one tooth height of the clamping teeth or control teeth.

The clamping teeth and control teeth are preferably the same size and are larger than the teeth of the toothed strip and of the rack. The movement of the locking device in the axial direction corresponds preferably roughly to half the width of one root of a clamping tooth or of a control tooth so that the successively positioned tooth tips can be moved into the nearest valley between the control teeth of the rack or the clamping teeth of the clamping bridge. The size of the clamping teeth or of the control teeth is accordingly so large that the width of a tooth root is between 0.5 and 15 mm. The tips of the clamping teeth and the tips of the control teeth are preferably flattened so that the flattened tips of the clamping teeth and of the control teeth can be advantageously positioned in the locking position on one another.

The clamping bridge is made as a separate component or alternatively integrally with the inner sleeve so that the inner sleeve has the clamping teeth. In a separate configuration, the clamping bridge is located and guided in the inner sleeve. In the release position the clamping teeth of the clamping bridge and the control teeth of the rack are at least temporarily engaged, specifically exactly when the rack is lifted up by sliding the teeth on the tooth of the toothed strip. If the control teeth are engaged to the clamping teeth, temporarily the teeth of the rack no longer engage the teeth of the toothed strip.

The rack is preferably guided with little play, for example, in the inner sleeve so that in the release position only one movement in the radial direction to the vacuum cleaner suction pipe is possible and is limited by the clamping bridge and the height of the clamping or control teeth. Since the height of the clamping teeth or of the control teeth and thus the movement of the rack in the radial direction are however exactly as great or greater than the teeth of the toothed strip or of the rack, telescoping of the vacuum cleaner suction pipe in the release position is possible.

To ensure advantageous actuation of the vacuum cleaner suction pipe, according to another configuration, it is provided that the clamping bridge can be moved by the bridge of the outer sleeve. The bridge of the outer sleeve extends through the wall of the outer pipe so that the end of the bridge is within the outer pipe. Preferably, the bridge on the inside of the outer pipe is connected to the spring so that it interacts with the spring. The locking device is actuated by axial displacement of the sleeve on the outer pipe. For this purpose, the clamping bridge is connected to the outer sleeve such that when the outer sleeve moves the clamping bridge is moved by the bridge. For example, for this purpose within the outer pipe there is a carriage on which the clamping bridge is located and which is guided on the inner pipe by its extending at least halfway around it. The bridge when moved causes an axial movement of the carriage and thus a displacement of the clamping bridge out of the locking position into the release position and vice versa. The connection between the bridge and the clamping bridge is alternatively also made as a simple plastic guide or as part of the inner sleeve. Preferably, the bridge of the outer sleeve is simultaneously connected to the spring and the clamping bridge so that the spring in the release position always causes a resetting of the clamping bridge into the locking position.

The bridge is consequently connected to the clamping bridge such that when the outer sleeve is displaced in the axial direction the clamping bridge is moved at the same time in the same axial direction, as a result of which the clamping teeth of the clamping bridge move relative to the control teeth of the rack and the release position is reached. In this way, the rack can move aside in the radial direction and the inner pipe and the outer pipe can be telescoped.

Furthermore, according to another configuration, it is preferred if the control teeth have a root width which corresponds to twice the root width of the teeth. Half the root width of the control teeth corresponds for example, roughly to the distance by which the locking device, especially the outer sleeve of the locking device, must be moved in order to travel out of the locking position into the release position. It follows from this that the locking device must be moved roughly by one tooth width of the teeth of the rack in order to travel out of the locking position into the release position. One tooth root width of the teeth of the rack is also roughly the distance by which the vacuum cleaner suction pipe can be minimally telescoped.

Another configuration is advantageous in that the rack has between five and fifteen teeth, especially that the rack has exactly eight teeth. A number between five and fifteen teeth of the rack in the locking position leads to advantageous stability of locking and reliably prevents the outer pipe and the inner pipe from being able to move relative to one another in the locking position, for example, by teeth breaking off, since between five and fifteen teeth make available a sufficient area for tooth transfer of force. In particular, eight teeth have proven especially advantageous.

According to another configuration, it is provided, if the clamping bridge has between two and five clamping teeth and the rack has between three and six control teeth, especially the clamping bridge has exactly three clamping teeth and the rack has exactly three entire and two half control teeth. The clamping teeth and the control teeth temporarily engage one another only in the release position of the vacuum cleaner suction pipe, specifically when the rack is moved away from the toothed strip by the flanks of the teeth of the toothed strip and the rack being lifted on one another. The aforementioned number of clamping teeth and control teeth leads to a reliable interaction of the clamping bridge and of the rack without the rack for example, being tilted or unstably guided. In particular the rack can be advantageously guided by half control teeth which are each located on the end of the clamping bridge.

According to a last configuration, the operation of the locking device is simplified by the locking device being deflectable in two axial directions; consequently therefore, the locking device can be moved into two release positions. The axial movement of the locking device, especially the outer sleeve of the locking device, can thus take place both in the direction of the inner pipe and also in the direction away from the inner pipe, a release position always being reached. The spring is provided such that it always causes a reset force into the locking position in the two directions. The clamping bridge in this configuration is also moved at the same time into one and also the other direction and in the release position enables the rack to be moved aside to disengage the teeth of the rack from the toothed strip.

In particular, there is now a host of possibilities for embodying and developing the vacuum cleaner suction pipe. In this regard reference is made to the following description of preferred exemplary embodiments in conjunction with the accompanying drawings.

DETAILED DESCRIPTION OF THE INVENTION

Figure 1:
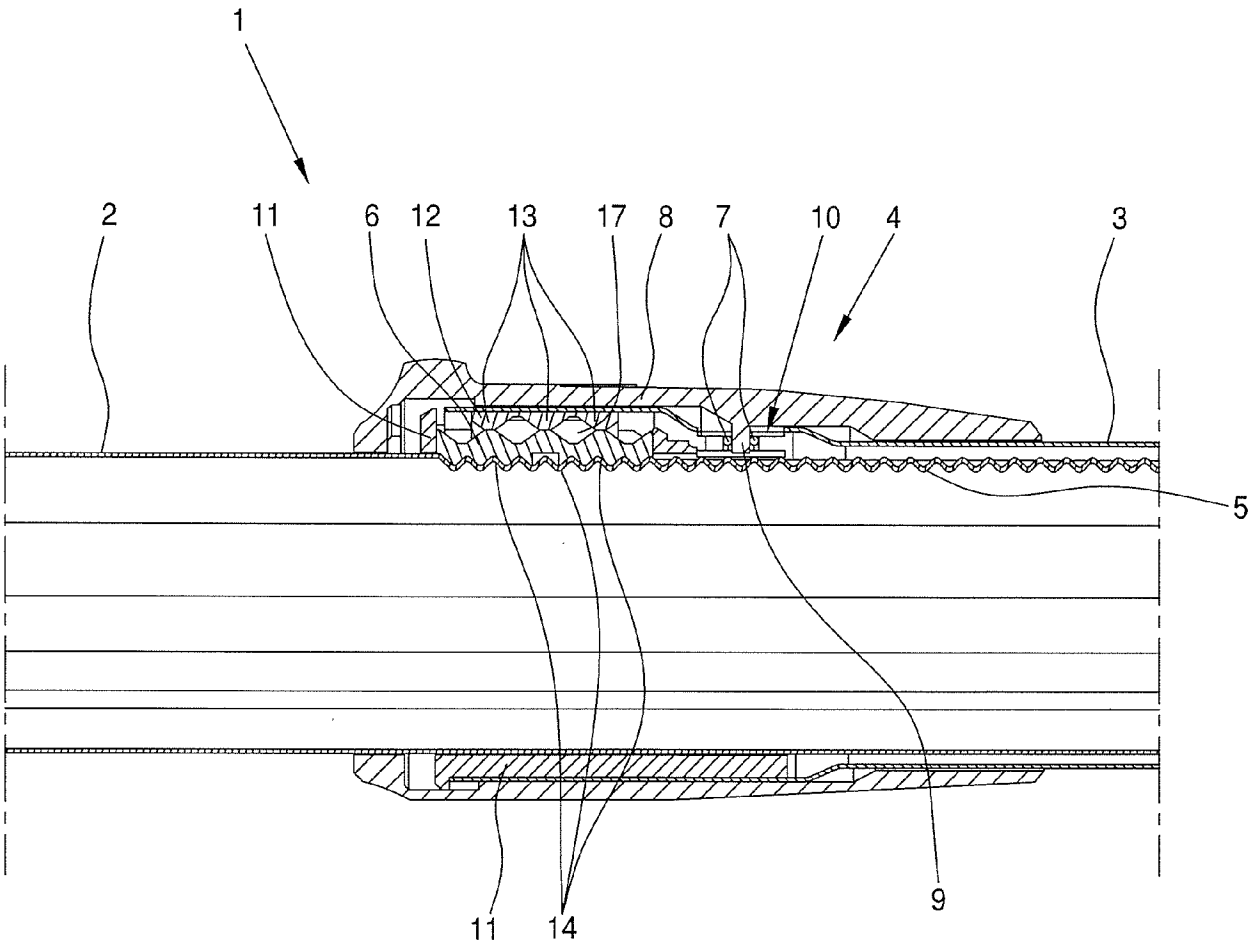
FIG. 1 is a sectional side view of an exemplary embodiment of a vacuum cleaner suction pipe with a locking device.

FIG. 1 shows one exemplary embodiment of a vacuum cleaner suction pipe 1 with an inner pipe 2, an outer pipe 3 and a locking device 4. The inner pipe 2 has a toothed strip 5 which, in this exemplary embodiment, is embossed into the inner pipe 2. The locking device 4 is movably attached to the outer pipe 3 and can be moved by manual actuation by a user out of the illustrated locking position into a release position. The locking device 4 has a rack 6 whose teeth in the illustrated locking position are kept engaged with the teeth of the toothed strip 5 of the inner pipe 2, as a result of which the inner pipe 2 is positionally fixed relative to the outer pipe 3 and the vacuum cleaner suction pipe 1 cannot be telescoped. The locking device 4 can be moved into the release position by manual displacement of the locking device 4 in the axial direction of the outer pipe 3 or of the inner pipe 2.

In the release position, the rack 6 is freely movable such that it can be pressed back to disengage from the toothed strip 5 without the effect of a spring force, as a result of which the inner pipe 2 and the outer pipe 3 can be displaced relative to one another by a relative force which is applied by a user. Here, the rack 6 is pressed up to disengage from the toothed strip 5 by the flanks of the teeth of the rack 6 sliding on the teeth of the toothed strip 5. The locking device 4 has a spring 7 which, when the locking device 4 is deflected out of the locking position into the release position, causes a force which sets the locking device 4 back into the locking position. In the inactive state, the locking device 4 is thus always in the locking position. To reach the release position, the locking device 4 has an outer sleeve 8 which is held on the outer pipe 3 to be movable relative to it in the axial direction of the outer pipe 3. The outer sleeve 8 in FIG. 1 can be displaced both to the left and also to the right, in both directions a release position being reached.

The outer sleeve 8 in the end region of the outer pipe 3 is slipped onto the latter and is connected to the outer pipe 3. The outer sleeve 8 has a bridge 9 which extends through the wall of the outer pipe in an opening 10 so that the bridge 9 interacts with the spring 7 which is located in the outer pipe 3. If the outer sleeve 8 according to FIG. 1 is deflected to the left or right, the spring 7 causes a reset force which sets the locking device 4, especially the outer sleeve 8, back into the locking position. The end region of the outer pipe 3 shown in FIG. 1 in this exemplary embodiment is made widened, an inner sleeve 11 of the locking device 4 being inserted into the widened end region of the outer pipe 3. The inner sleeve 11 is connected to the spring 7, keeps the spring 7 in its position, and thus, constitutes an abutment for the spring 7.

The locking device 4 also has a clamping bridge 12 which acts with the clamping teeth 13 on the control teeth 14 of the rack 6 such that in the locking position the teeth of the rack 6 are kept engaged to the toothed strip 5. The control teeth 14 are located on the surface which is opposite the teeth of the rack 6. The tips of the clamping teeth 13 and the tips of the control teeth 14 are flattened in this exemplary embodiment and are in contact with one another in the locking position.

The bridge 9 of the outer sleeve 8 is connected to the clamping bridge 12 such that, when the outer sleeve 8 is moved in one direction, according to FIG. 1 to the left or to the right, the clamping bridge 12 is moved at the same time over the bridge 8 so that the clamping bridge 12 moves parallel to the outer sleeve 8. To reach the release position, the clamping bridge 12 is thus moved to the left or right, according to FIG. 1, so that the clamping teeth 13 can be engaged to the control teeth 14, at the same time the engagement of the teeth of the rack 6 with the teeth of the toothed strip 5 being temporarily eliminated, the teeth of the rack 6 and the teeth of the toothed strip 5 sliding on one another on their tooth flanks when in the release position and a displacement force is applied to the inner pipe 2 by a user. The rack 6 is pushed up without the influence of a spring force, according to FIG. 1. In the release position, consequently, the control teeth 14 of the rack 6 can move aside into the intermediate spaces between the clamping teeth 13 of the clamping bridge 12. The spring 7 causes a reset force out of the release position into the locking position.

Figure 2:
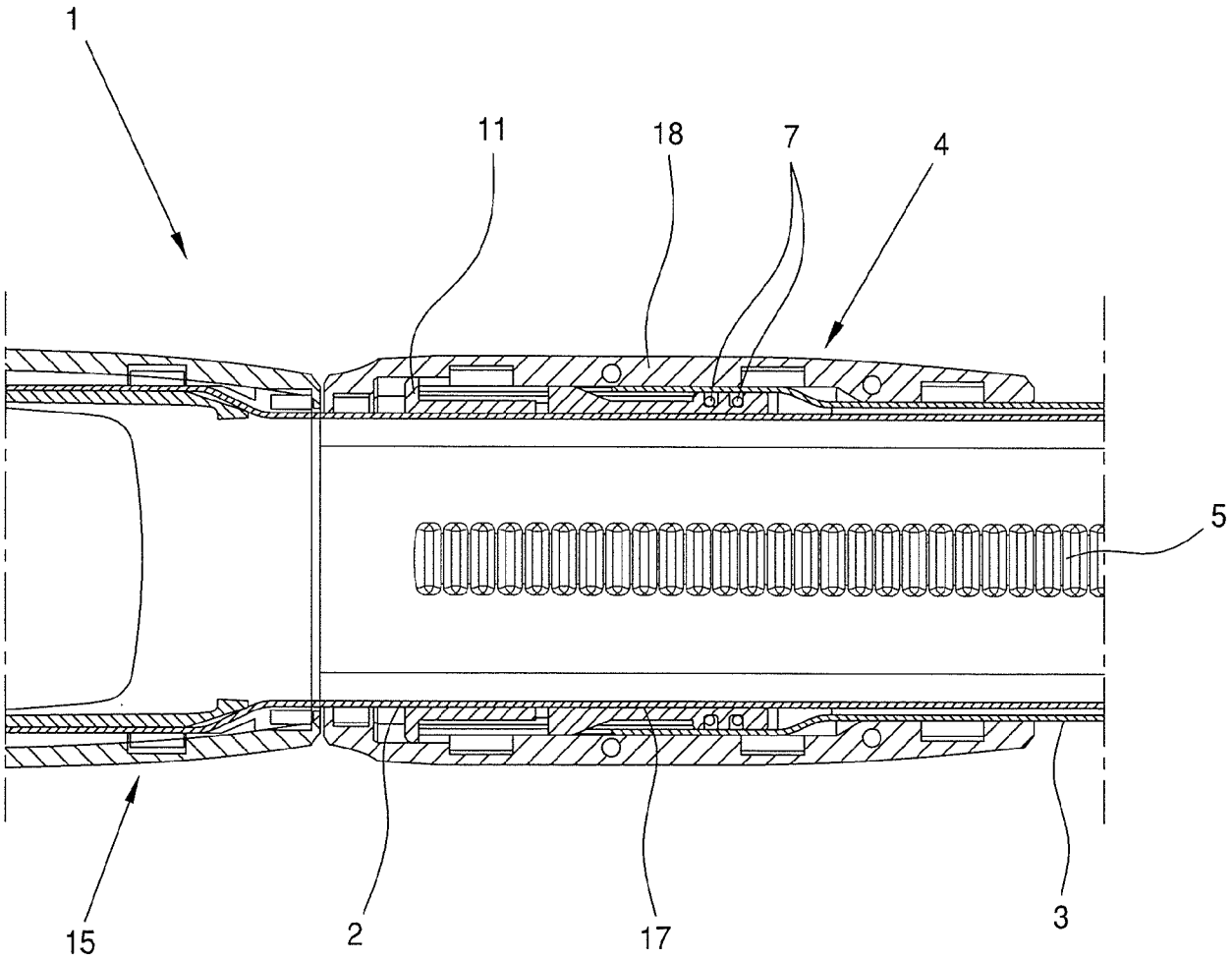
FIG. 2 is a sectional side view of the FIG. 1 embodiment of a vacuum cleaner suction pipe with a locking device rotated 90° relative to the view of FIG. 1.

FIG. 2 shows a section of the exemplary embodiment of a vacuum cleaner suction pipe 1 turned by 90° relative to the view in FIG. 1. In the left region of FIG. 2, an end region 15 of the inner pipe 2 is shown in which there is a means for connecting the vacuum cleaner suction pipe 1 to the suction hose. This means is relatively well known in the prior art and is therefore need not be explained in detail. The vacuum cleaner suction pipe in this view is set to its shortest length so that the inner pipe 2 runs completely within the outer pipe 3 and only the end region 15 with the connection means projects out of the outer pipe 3.

FIG. 2, at the right, shows the locking device 4 with an outer sleeve 8 which is applied to the widened end region of the outer pipe 3. In this view, the toothed strip 5 of the inner pipe 2 is shown looking from within the inner pipe. The toothed strip 4 is embossed into the wall of the inner pipe 2. The inner sleeve 11 is inserted into the widened end region of the outer pipe 3. The spring 7 which is fixed laterally in the inner sleeve 11 is used to reset the locking device 4 into the illustrated locking position. The outer sleeve 8 is fastened on the outer pipe 3 in an axially movable manner.

Figure 3:
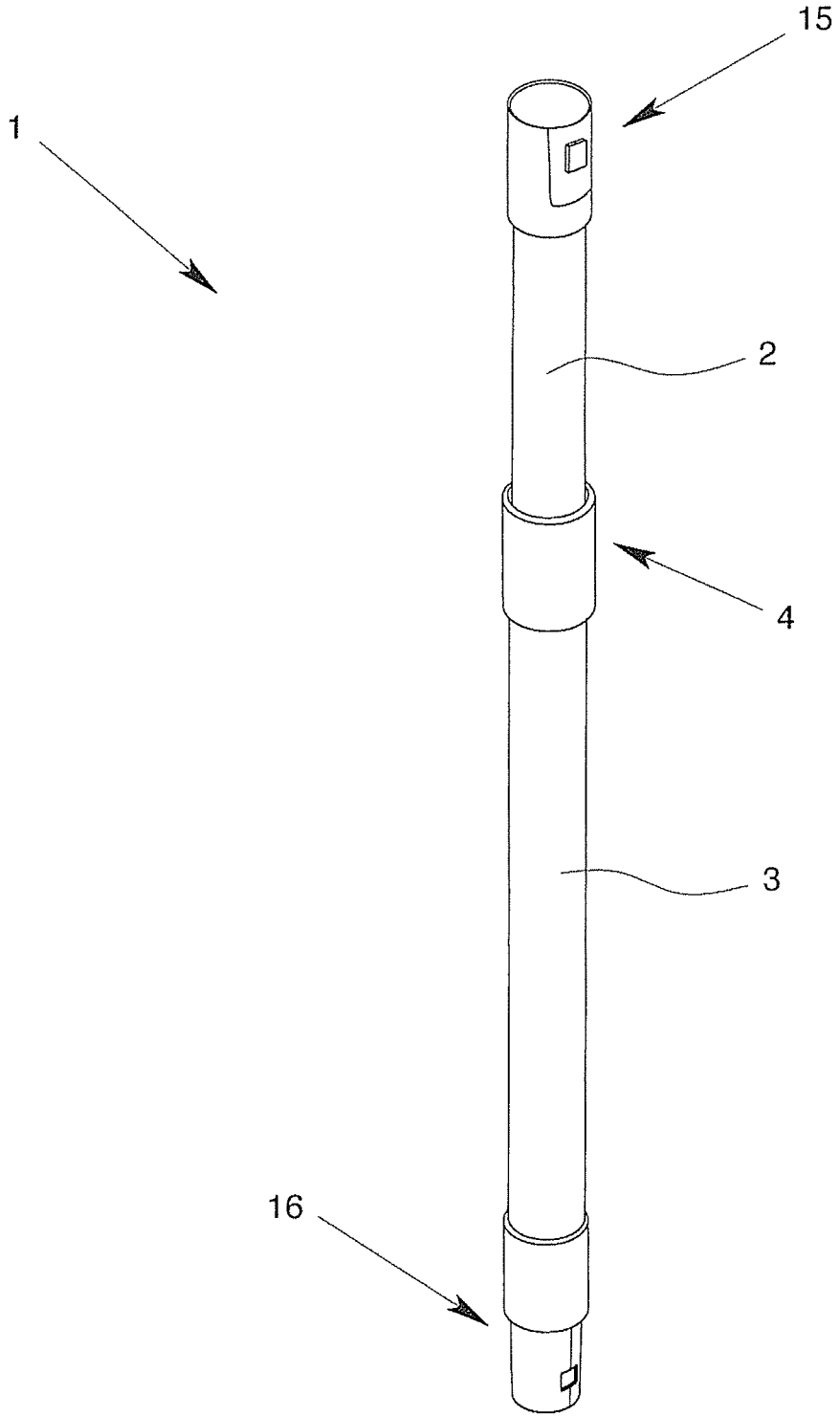
FIG. 3 is a perspective view of the exemplary embodiment of a vacuum cleaner suction pipe.

FIG. 3 shows an end region 15 of the inner pipe 2 projecting out of the outer pipe 3. The end region 15 of the inner pipe 2 is used for the known connection to the suction hose of a vacuum cleaner. The end region 16 of the outer pipe 3 is used for the likewise known connection, for example, to a floor nozzle. The configuration of the end regions 15 of the inner pipe and of the end region 16 of the outer pipe is relatively well known in the prior art so that it is need not be further explained. The length of the inner pipe 2 corresponds roughly to the length of the outer pipe 3.

According to FIG. 1, the clamping bridge 6 is located on a carriage 17. The clamping bridge 6 is connected via the carriage 17 to the bridge 9 of the outer sleeve 8 so that when the bridge 9 is moved by the outer sleeve 8, the carriage 17 and thus the clamping bridge 6 are moved. The clamping bridge 6 thus moves parallel to the outer sleeve 8 and can be moved between the release position and the locking position.

What is claimed is:

1. A vacuum cleaner suction pipe, comprising:

at least one inner pipe having a toothed strip, at least one outer pipe, and at least one locking device attached to the outer pipe, the locking device being manually movable by user actuation from a locking position into a release position, the locking device having a toothed rack, and in the locking position, the rack being kept engaged with the toothed strip of the inner pipe, as a result of which the inner pipe is positionally fixed relative to the outer pipe, wherein the locking device is movable into the release position by displacement relative to the outer pipe in an axial direction of the outer pipe, and wherein the rack, in the release position, is pressable out of engagement with the toothed strip by a relative force between the outer pipe and inner pipe, independent of an additional spring force effect stabilizing a set position, by flanks of the teeth of the toothed strip pushing flanks of the teeth of the rack upward, enabling the inner pipe to be displaced relative to the outer pipe.

2. The vacuum cleaner suction pipe as claimed in claim 1, wherein the at least one locking device has a spring, and wherein the spring is adapted to induce a force acting in a direction toward the locking position when the locking device is deflected out of the locking position.

3. The vacuum cleaner suction pipe as claimed in claim 1, wherein the at least one locking device has an outer sleeve, wherein the outer sleeve is slipped onto an end region of the outer pipe and wherein the release position is reached by axial displacement of the outer sleeve.

4. The vacuum cleaner suction pipe as claimed in claim 3, wherein the at least one locking device has a spring which is located in the outer pipe, wherein the spring is adapted to induce a force acting in a direction toward the locking position when the locking device is deflected out of the locking position, wherein the outer sleeve has a bridge, wherein the bridge extends through an opening in a wall of the outer pipe, and wherein the bridge interacts with the spring.

5. The vacuum cleaner suction pipe as claimed in claim 1, wherein the outer pipe is widened in an end region, wherein the at least one locking device has an inner sleeve and wherein the inner sleeve is located in the widened end region.

6. The vacuum cleaner suction pipe as claimed in claim 1, wherein the at least one locking device has a clamping bridge, wherein the clamping bridge acts on a surface of the rack that is on an opposite side of the rack from the rack teeth in the locking position, and wherein the clamping bridge releases movement of the rack in the release position to disengage it from the toothed strip.

7. The vacuum cleaner suction pipe as claimed in claim 6, wherein the clamping bridge has clamping teeth, wherein the rack has control teeth on the surface facing away from the teeth, wherein the tips of the clamping teeth act on the tips of the control teeth in the locking position, and wherein the clamping bridge is movable relative to the rack by an axial displacement of the locking device so that the clamping teeth and the control teeth engage in the release position.

8. The vacuum cleaner suction pipe as claimed in claim 7, wherein the control teeth have a root width which corresponds to twice a root width of the teeth of the rack.

9. The vacuum cleaner suction pipe as claimed in claim 7, wherein the clamping bridge has between two and five clamping teeth and the rack has between three and six control teeth.

10. The vacuum cleaner suction pipe as claimed in claim 7, wherein the clamping bridge has exactly three clamping teeth and the rack has exactly three entire and two half control teeth.

11. The vacuum cleaner suction pipe as claimed in claim 6, wherein the at least one locking device has an outer sleeve, wherein the outer sleeve is slipped onto an end region of the outer pipe and wherein the release position is reached by axial displacement of the outer sleeve, wherein the outer sleeve has a bridge, wherein the bridge extends through an opening in a wall of the outer pipe, and wherein the clamping bridge is movable by the bridge of the outer sleeve.

12. The vacuum cleaner suction pipe as claimed in claim 1, wherein the rack has between five and 15 teeth.

13. The vacuum cleaner suction pipe as claimed in claim 1, wherein the rack has exactly eight teeth.

14. The vacuum cleaner suction pipe as claimed in claim 1, wherein the at least one locking device is deflectable in two axial directions so as to be movable into two release positions.

* * * * *